US008151408B2

(12) United States Patent
Finke et al.

(10) Patent No.: US 8,151,408 B2
(45) Date of Patent: Apr. 10, 2012

(54) UPRIGHT VACUUM CLEANER

(75) Inventors: Christian Finke, Bielefeld (DE); Michael Poetting, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 831 days.

(21) Appl. No.: 12/199,478

(22) Filed: Aug. 27, 2008

(65) Prior Publication Data

US 2009/0056064 A1 Mar. 5, 2009

(30) Foreign Application Priority Data

Aug. 30, 2007 (DE) ..... 10 2007 040 960

(51) Int. Cl.
*A47L 5/00* (2006.01)

(52) U.S. Cl. ..... 15/327.2; 15/351; 15/410

(58) Field of Classification Search ..... 15/327.2, 15/351, 410, 411; *A47L 5/00*
See application file for complete search history.

(56) References Cited

U.S. PATENT DOCUMENTS

| | | | |
|---|---|---|---|
| 5,794,305 | A | 8/1998 | Weger |
| 2003/0051307 | A1 | 3/2003 | Hashizume et al. |
| 2009/0056065 | A1 | 3/2009 | Finke |

FOREIGN PATENT DOCUMENTS

| | | | |
|---|---|---|---|
| CA | 2 181 876 | A1 | 1/1998 |
| EP | 0708613 | A1 | 5/1996 |
| GB | 2342282 | A | 4/2000 |
| GB | 2410178 | A | 7/2005 |
| GB | 2422094 | A | 7/2006 |
| WO | WO-2004014209 | A1 | 2/2004 |
| WO | WO 2006/069334 | A2 | 6/2006 |
| WO | WO-2007008770 | A2 | 1/2007 |

OTHER PUBLICATIONS

European Search Report for EP 08 01 4602, dated Nov. 2, 2010.

*Primary Examiner* — David Redding
(74) *Attorney, Agent, or Firm* — Leydig, Voit & Mayer, Ltd.

(57) ABSTRACT

An upright vacuum cleaner for cleaning a surface includes an upper body with a dust collection container disposed therein, a base unit and a carriage configured to provide movement of the base unit on the surface. A tilting joint connects the upper body and base unit. The tilting joint is configured to provide relative tilting between the upper body and the base unit about a tilting axis extending horizontally when the upright vacuum cleaner is in a position of use. At least one cover configured to cover a clearance in a vicinity of the tilting joint between the upper body and the base unit.

17 Claims, 7 Drawing Sheets

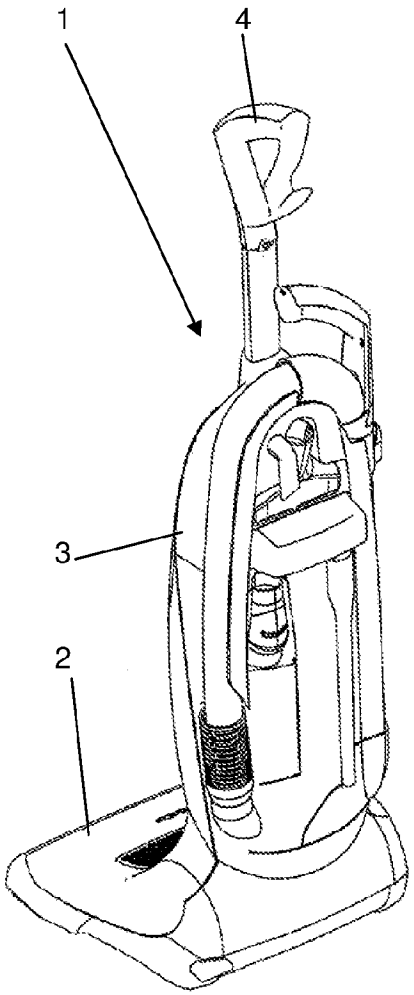
Fig. 3
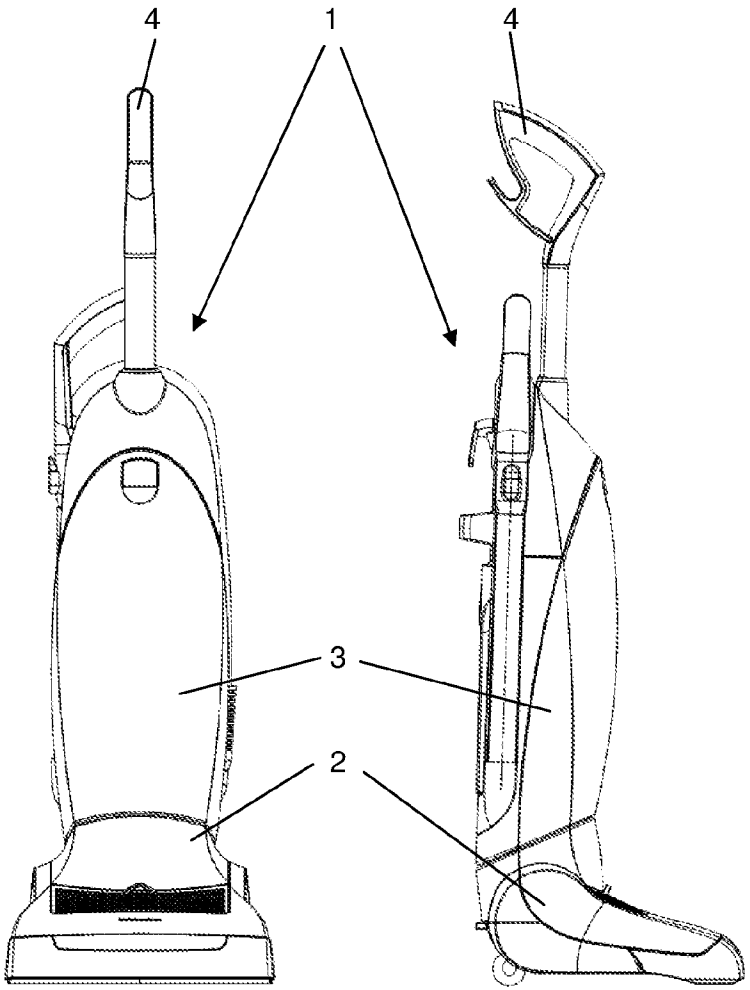
Fig. 2
Fig. 1

UPRIGHT VACUUM CLEANER

CROSS REFERENCE TO RELATED APPLICATIONS

Priority is claimed to German patent application DE 10 2007 040 960.7 filed Aug. 30, 2007, which is hereby incorporated by reference.

FIELD

The present invention relates to a vacuum cleaner of the upright type, including an upper body containing a dust collection container, a base unit, a carriage permitting said base unit to move on the surface to be cleaned, and a tilting joint which is located between the upper body and the base unit and connects the upper body and the base unit in such a manner that they can be tilted relative to each other about an axis extending horizontally in a position of use.

BACKGROUND

The following is a description of three types of vacuum cleaners which differ in design and operation. All of them have as common features a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor-fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor-fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts are tiltable relative to each other and can usually be locked in a parked position in which the upper body is nearly upright when the base unit is located on a horizontal floor in a position of use. In this position, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. The motor-fan unit may be mounted at different locations. WO 2007/008770 A2, for example, describes securing the fan directly to the upper body. WO 2004/014209 A1a fan that is configured as a separate unit. A point of rotation provided between the upper body and the upper region of the fan, as described in EP 0 708 613 A1, can enable an upright to move along curved paths, thereby improving maneuverability. In some uprights the motor-fan unit is located in the base unit. In such upright cleaners, the articulated connection between the base unit and the upper body is provided by a hinge-like structure. Due to the possible pivoting movement, clearances are created between the upper body and the base unit, into which the operator may reach. This may then lead to the risk of fingers being pinched during a pivoting movement in an opposite direction. It is also desirable for reasons of appearance that components that are less important in terms of visual design should not be visible in the clearances.

SUMMARY

An aspect of the present invention to provide an upright vacuum cleaner in which clearances are reduced or prevented from being formed by relative movements between the upper body and the base unit.

In an embodiment, the present invention provides an upright vacuum cleaner for cleaning a surface including an upper body with a dust collection container disposed therein, a base unit and a carriage configured to provide movement of the base unit on the surface. A tilting joint connects the upper body and base unit. The tilting joint is configured to provide relative tilting between the upper body and the base unit about a tilting axis extending horizontally when the upright vacuum cleaner is in a position of use. At least one cover is configured to cover a clearance in a vicinity of the tilting joint between the upper body and the base unit.

BRIEF DESCRIPTION OF THE DRAWINGS

An exemplary embodiment of the present invention will be described in more detail below and is schematically shown in the drawings, in which:

FIGS. 1 through 6 show various overall views of the vacuum cleaner of the present invention;

DETAILED DESCRIPTION

Figure 4:
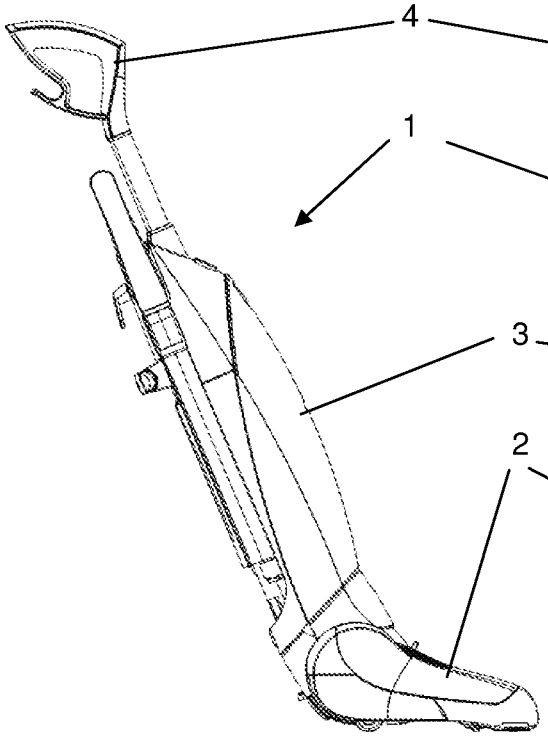

The present invention relates to an upright vacuum cleaner, including an upper body containing a dust collection container, a base unit, a carriage permitting said base unit to move on the surface to be cleaned, and further including a tilting joint which is located between the upper body and the base unit and connects the upper body and the base unit in such a manner that they can be tilted relative to each other about an axis extending horizontally in a position of use.

In an embodiment, the present invention provides an upright vacuum cleaner with at least one cover to cover at least one clearance in the region of the tilting joint between the upper body and the base unit.

In an embodiment, the cover has a sliding covering member or skirt associated therewith, the skirt covering a gap formed between the cover and the base unit as a result of the pivoting movement. In this manner, even the smallest gaps are covered, thus eliminating any risk of injury.

In one embodiment, the invention provides means which will automatically move the skirt to an extended position during a gap-increasing pivoting movement, thereby enhancing user convenience.

A stop means may be include to slide the skirt to a retracted position during a gap-reducing pivoting movement. This makes it possible to prevent the skirt from rubbing against visible housing parts.

In an embodiment, the invention includes at least two covers, because clearances may be formed and closed on both sides of the tilting joint.

Thus, a front cover may serve to cover a clearance in the upper region of the base unit. The front cover can have a front skirt slidably supported in a guide on the base unit. The means which automatically move the front skirt to an extended position may simply be provided by cooperating catch elements provided on the front skirt and on the front cover. The stop means which pushes the front skirt to the retracted position may be provided by a component part of the tilting joint.

A rear cover may serve to cover a clearance in the lower region of the base unit. The rear cover should have at least one cut-out which, during a pivoting movement which causes a gap in the lower region of the base unit to be reduced, prevents contact with at least one wheel provided on the base unit. This prevents the wheels from locking when the upper body is tilted down very far. Advantageously, in order to prevent the gaps occurring between the cover and the wheels, a rear skirt is provided to cover the cut-out during a pivoting movement which causes the gap in the lower region of the base unit to be increased. This rear skirt can be slidably secured to the rear cover. The means which automatically move the rear skirt to an extended position may be provided by cooperating catch elements provided on the rear skirt and on a lower housing part. It is also advantageous if the stop means which pushes the rear skirt to the retracted position is provided on the lower housing part. The stop means should be dimensioned such that it prevents contact of the skirt with the wheel.

The covers can be mounted to a yoke-shaped duct member which forms part of the tilting joint.

The upright vacuum cleaner shown in different views in FIGS. 1 through 6 (hereinafter abbreviated as upright 1) includes a base unit 2, an upper body 3, and a joint disposed therebetween, which will be described in greater detail further on in this specification.

Figure 7:
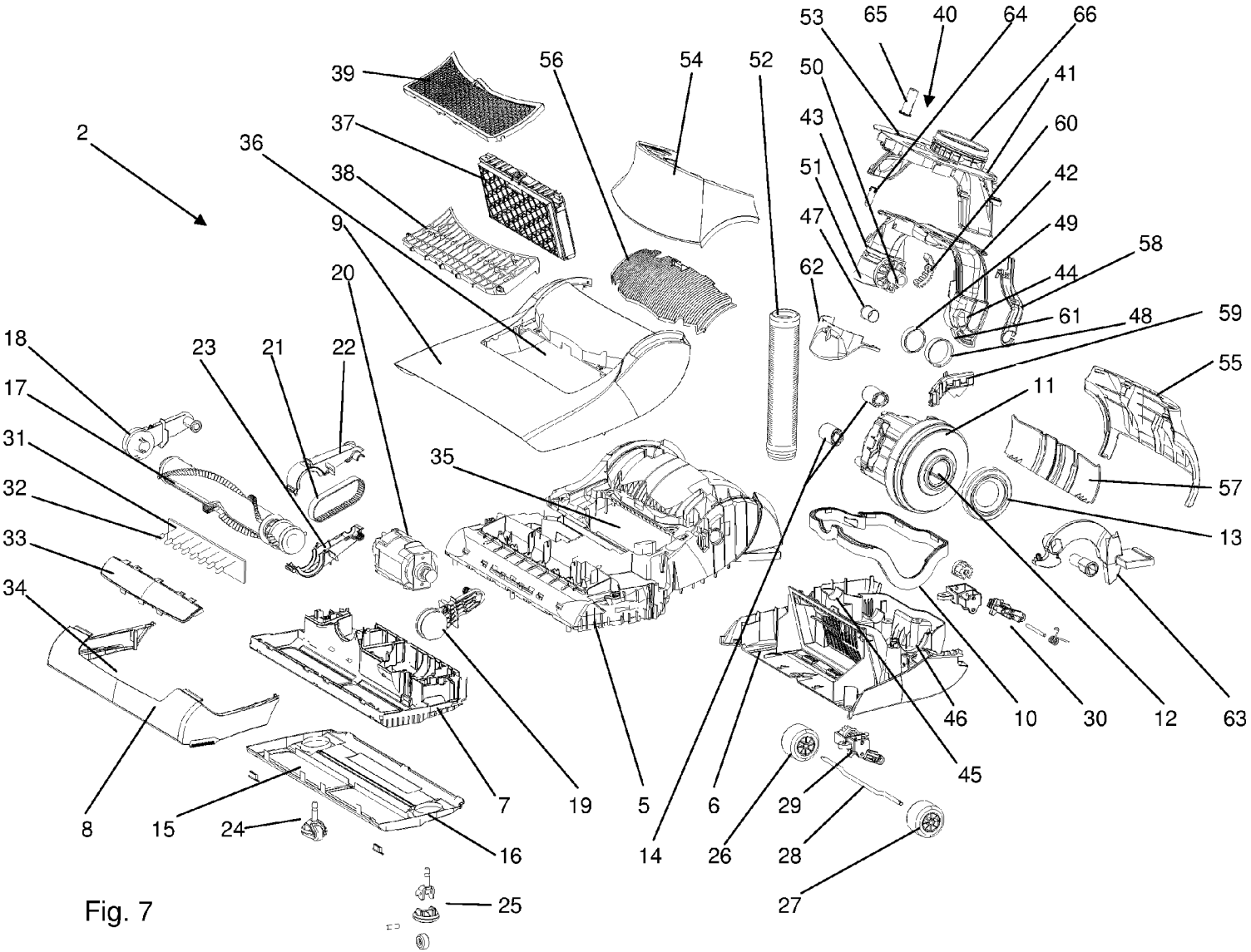
FIG. 7 is an exploded view showing the base unit of the vacuum cleaner.

Upright 1 can be brought from an upright parked position (see FIGS. 1 through 3), in which it can be locked and stand unsupported, to a tilted position (FIGS. 4 and 5), or even to a fully flat operating position (FIG. 6), after the locked engagement has been released (see FIG. 7). To this end, base unit 2 and upper body 3 are connected in such a manner that they can be tilted relative to each other about an axis X extending horizontally in a position of use (see FIG. 5). This pivoting movement is made possible by a joint which is hereinafter referred to as "tilting joint". In the tilted operating position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as "swivel joint".

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members or skirts 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the parked position (FIGS. 1 through 3), a foot pedal 63 is mounted on housing insert 5 which, in this position, engages with left yoke end 44, thereby preventing yoke 40 from swiveling. The locked position can be released by depressing pedal 63. Moreover, in the parked position, swivel motion is prevented by two spring-mounted pins 64 and 65. In the region of bridge portion 53, the air passages provided by yoke ends 43 and 44 are combined into a first section 66 of a coaxial conduit.

Figure 8:
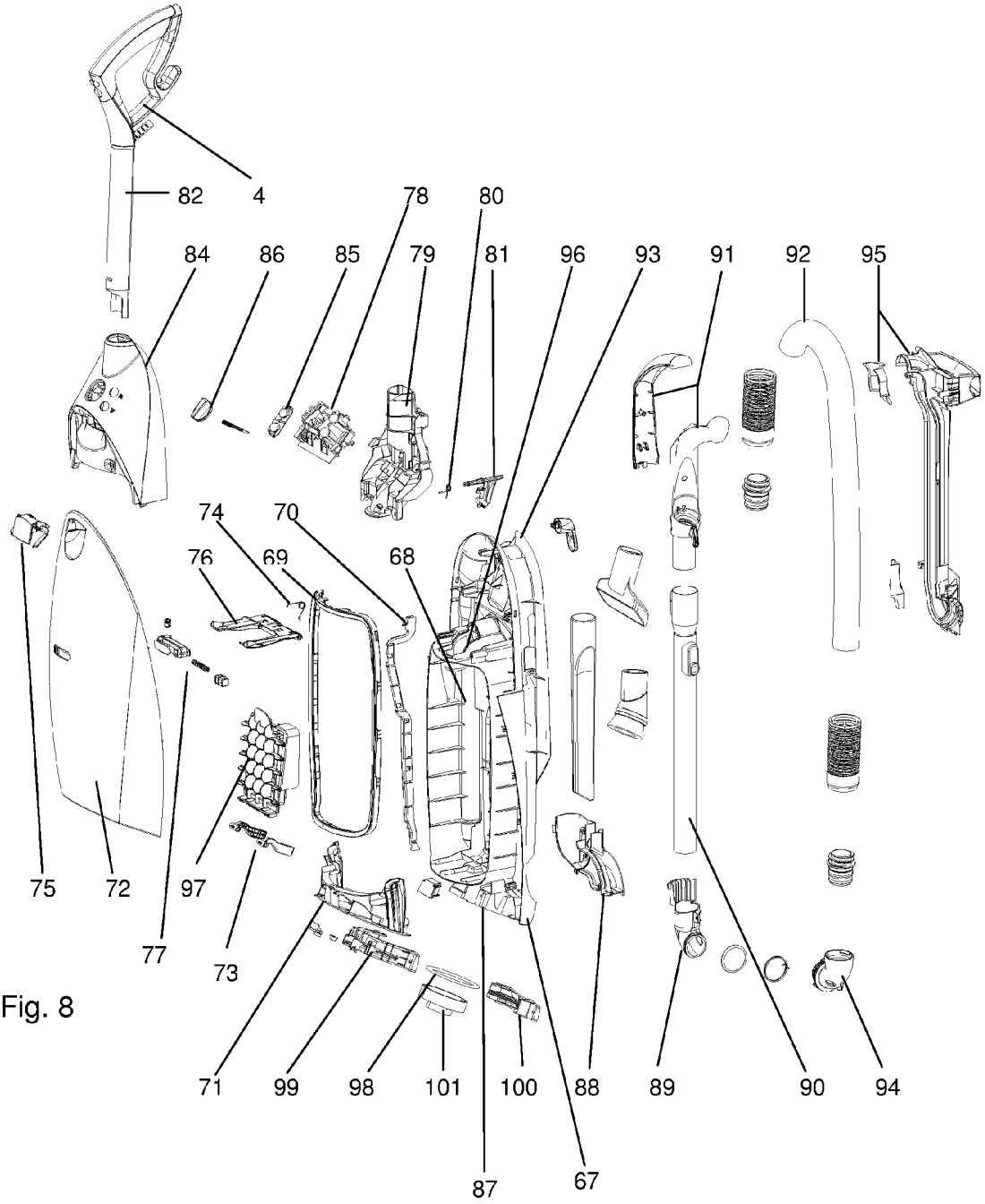
FIG. 8 is an exploded view illustrating the upper body of the vacuum cleaner.

FIG. 8 shows upper body 3, also in an exploded view. The load-bearing part of upper body 3 is a rear wall 67. The aforesaid rear wall forms the rear portion of dust chamber 68, which in turn receives a filter bag. A seal 69 surrounds the edge of dust chamber 68, and a covering strip 70 for cables is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4. Electronics 78 are covered by a cap 84, which also serves for attachment of various controls and indicators and accessories thereof (transparent cover 85, rotary knob 86).

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct which extends along the entire length of rear wall 67. The duct is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows the frame 97 for holding the filter) and into the outer annulus of second section 87 of the coaxial conduit, and from there through first section 66 and left yoke end 44 to motor-fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

As already described above, front and rear covers 54 and 55 are provided and are attached to bridge portion 53. Because rear covers 54 and 55 are attached at this location, i.e., below the swivel joint, they do not follow the rotational movements of upper body 3 and, therefore, remain stationary with respect to base unit 2 during such movements. However, since the covers are attached above the tilting joint, they follow the pivoting movement of upper body 3 when upper body 3 is being tilted, thus making it impossible to look into clearances created between upper body 3 and base unit 2. In order to also cover gaps formed when the upper body is in the extreme positions shown in FIGS. 2 and 6, covers 54 and 55 have associated therewith a sliding front skirt 56 and a sliding rear skirt 57, respectively.

Figure 9A:
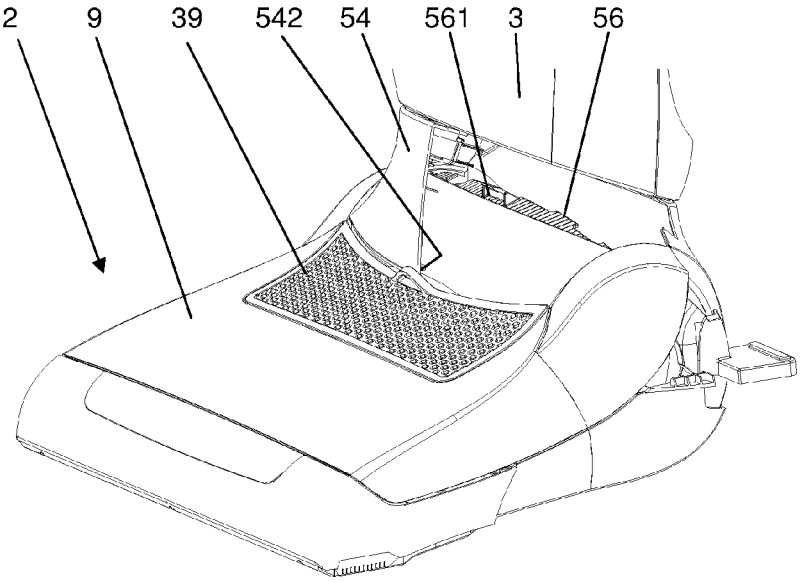
FIGS. 9*a* through 9*c* are partially sectional views illustrating the movement of the front cover and skirt during different tilt angles of the upper body.
Figure 9B:
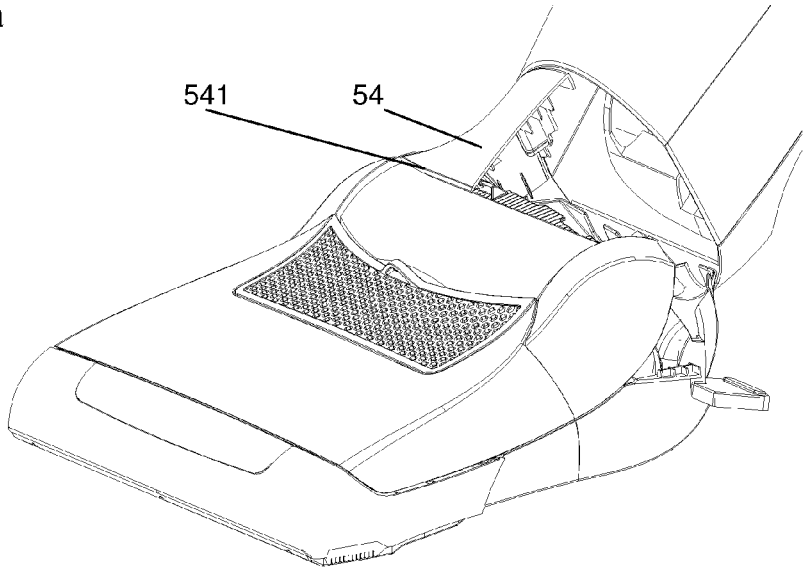
Figure 9C:
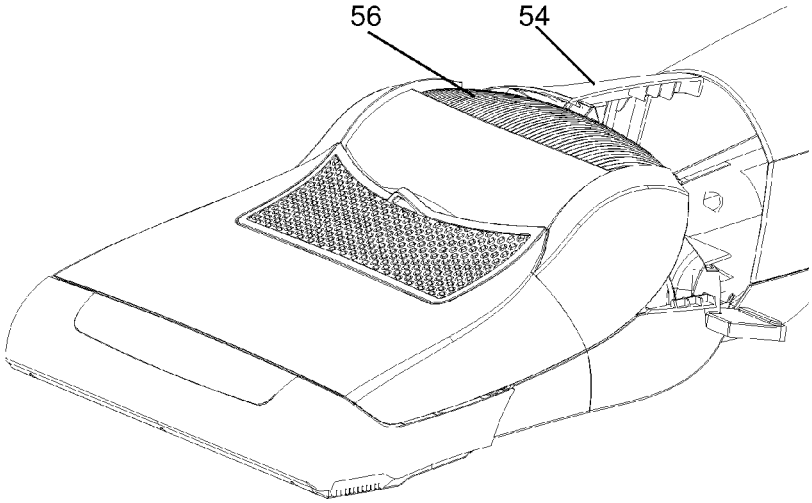

FIGS. 9*a* through 9*c* are partial sectional views illustrating the configuration of front cover 54 and the front skirt 56 associated therewith. Front cover 54 is shaped in the manner of a visor. When tilting upper body 3, lower edge 541 of the front cover follows the contour of cover part 9 above grating 39 (see FIGS. 9*a* and 9*b*). When assembling housing insert 5 and cover part 9, two guides are formed in the lateral regions to slidably receive front skirt 56 therein. The front skirt is provided at its upper edge with a first catch element 561, which is located in the path of movement of a second catch element 542, which is provided on cover 54. When tilting upper body 3 beyond the tilt angle shown in FIG. 9*b*, which is about 40°, to the flat position shown in FIG. 9*c*, first and second catch elements 561 and 542 are brought into engagement. In the process, skirt 56 is pulled from its retracted position below cover part 9 (FIGS. 9*a* and 9*b*) to the extended position shown in 9*c*, and covers the gap which would otherwise occur between cover 54 and cover part 9. When tilting upper body 3 back from the position shown in FIG. 9*c* through that shown in 9*b* and further to the position shown in 9*b*, yoke 40 move also and abuts against skirt 56. Thus, yoke 40 functions as a stop means and pushes skirt 56 back to the retracted position.

Figure 5:
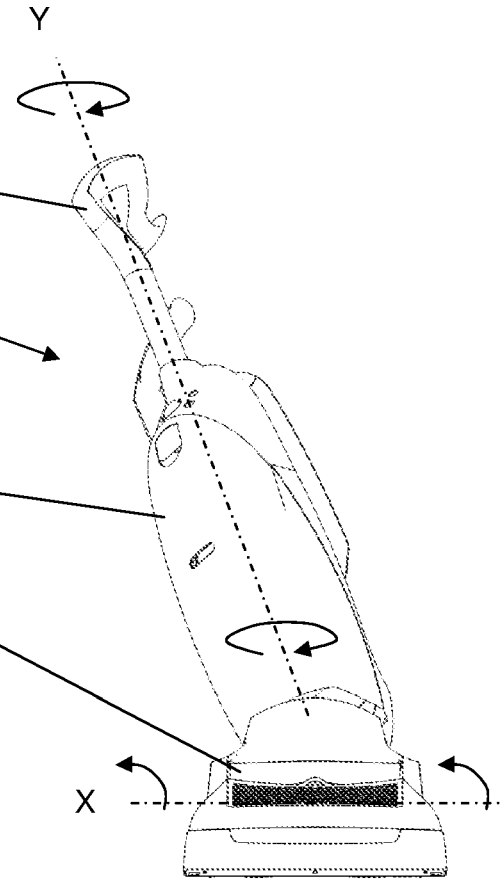
Figure 6:
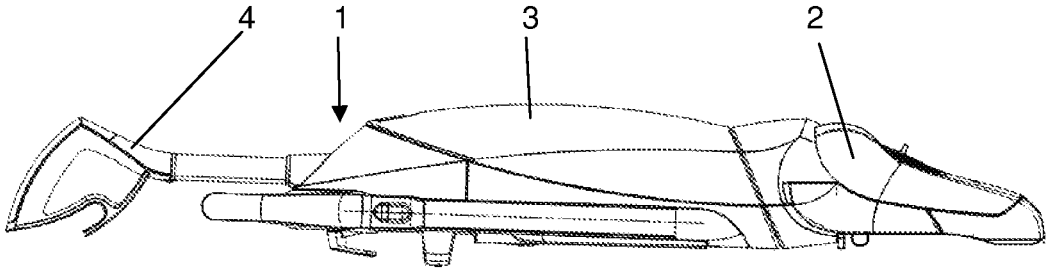
Figure 10:
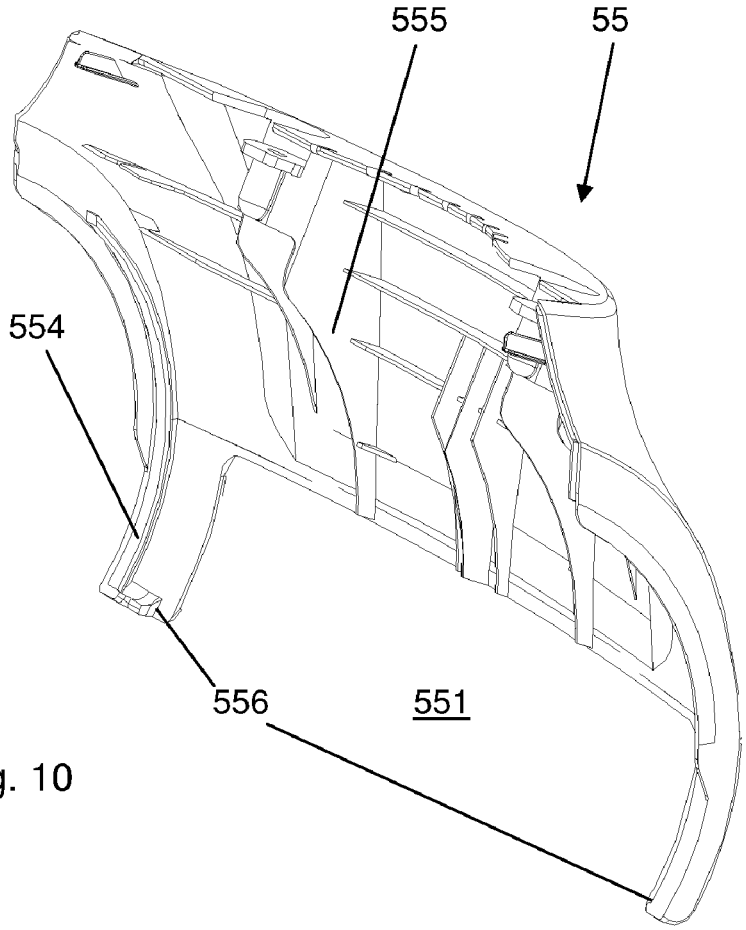
FIG. 10 is an isolated view of the rear cover.

A comparison of FIGS. 2 and 4 shows that rear wheels 26 and 27 are in different positions depending on the tilt angle of upper body 3. In the parked position (FIG. 2), rear wheels 26 and 27 are moved rearward by wheel mechanisms 29 and 30 so as to increase the footprint. In the operating position (FIG. 4), rear wheels 26 and 27 are moved forward so as to improve maneuverability. Rear cover 55 serves primarily to cover the clearance left by rear wheels 26 and 27 during their forward movement. In order to prevent rear cover 55 from coming into contact with rear wheels 26 and 27 when upper body 3 is tilted further to the flat position (FIG. 6), a cut-out 551 is provided, which is covered by rear skirt 57 (see FIGS. 10 and 11). FIGS. 12*a* and 12*b* illustrate the configuration of rear cover 55 and rear skirt 57, and the operation thereof. These figures show a variant in which a separate cut-out 552 and 553 is provided for each wheel 26 and 27, respectively. As is shown in FIG. 11, the skirt is a single part.

Figure 11:
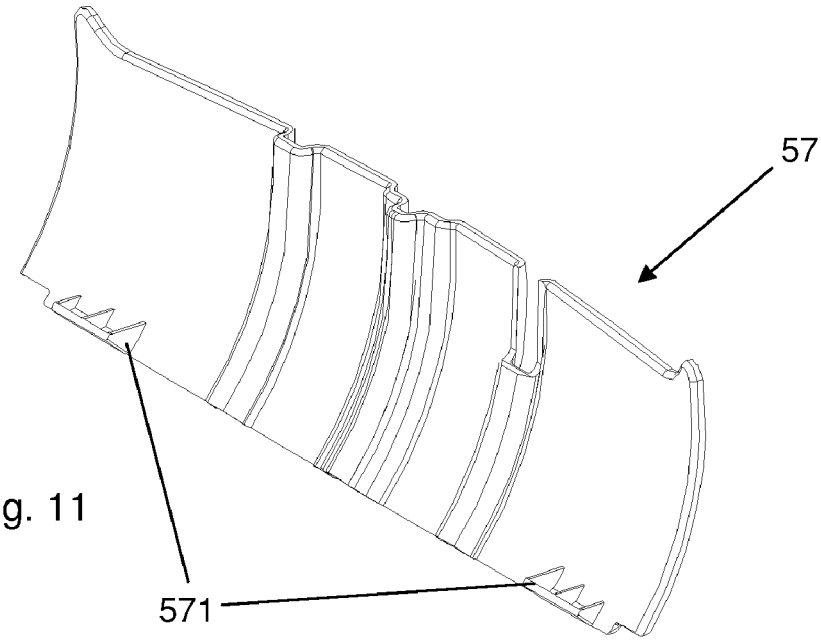
FIG. 11 is an isolated view of the rear skirt.
Figure 12A:
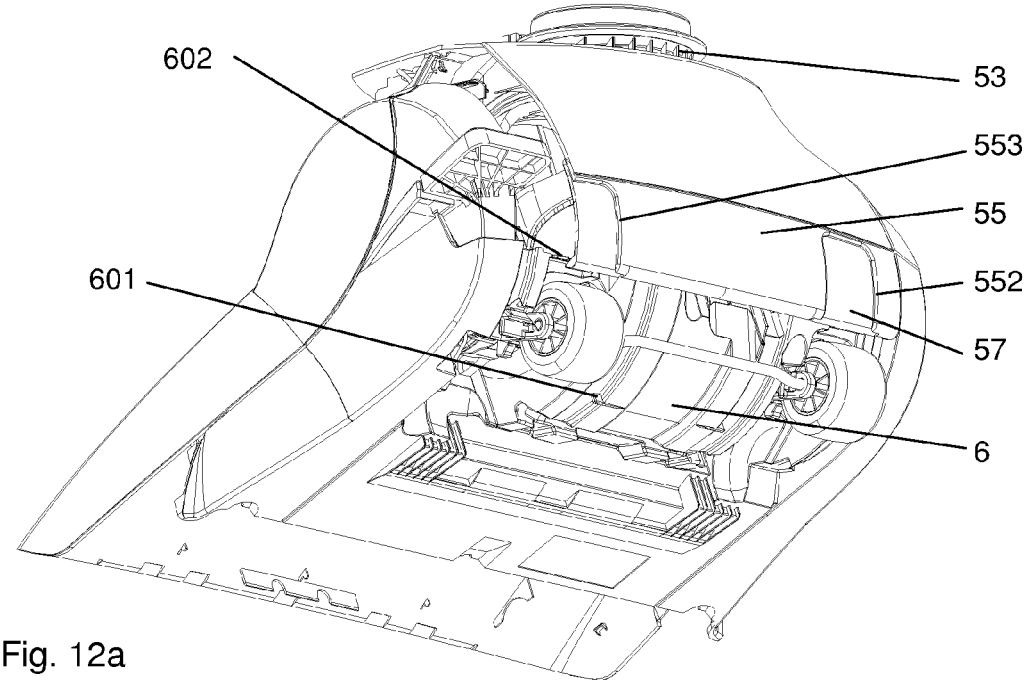
FIGS. 12*a* and 12*b* are bottom views illustrating the movement of the rear cover and skirt during different tilt angles of the yoke.
Figure 12B:
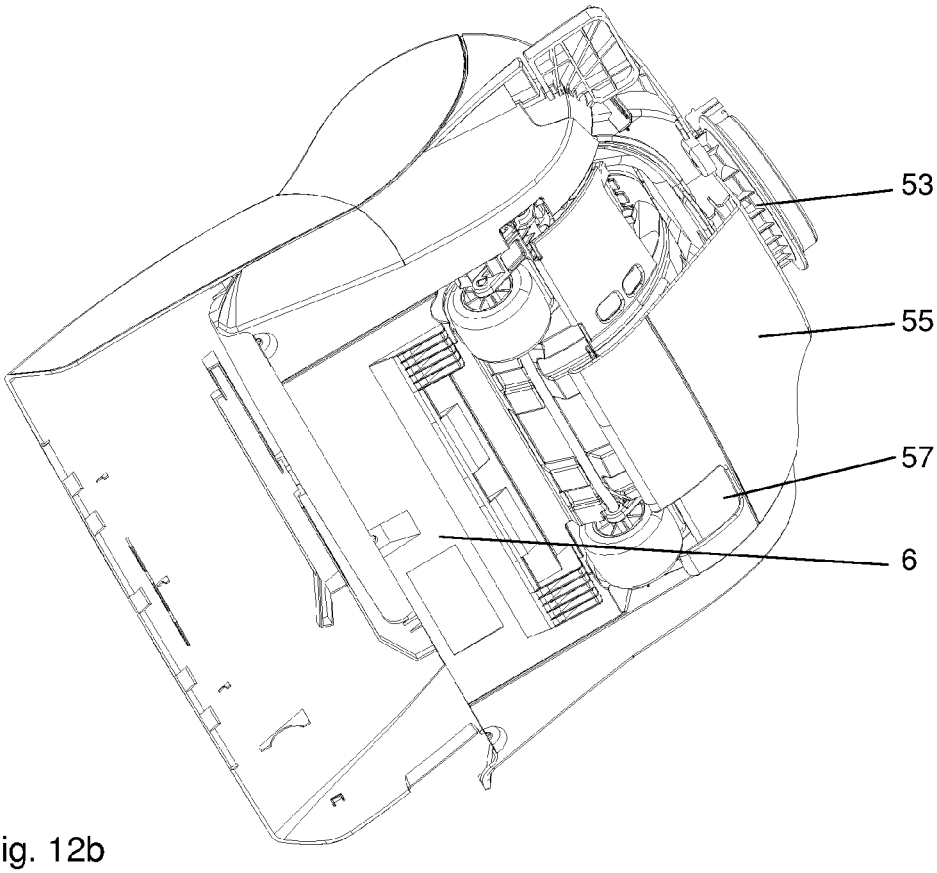

FIG. 4 shows the rear cover in an isolated view, and FIG. 11 shows the rear skirt. The cover is attached in its upper portion to bridge portion 53 (see FIGS. 12*a* and 12*b*), and is provided with a groove 554 in each of its side edges to slidably support rear skirt 57 therein. Reinforcing webs 555 serve to guide rear skirt 57 in the middle region. The lower edge of the cover is provided with stop edges 556 which limit the sliding path of rear skirt 57. Since rear cover 55 is attached to bridge portion 53, it rests only loosely on lower rear housing part 6 and moves relative to lower part 6 when upper body 3 is being tilted. This becomes apparent when comparing FIGS. 12*a* and 12*b*. In FIG. 12*a*, base unit 2 is shown in a condition in which the position of the yoke corresponds to the parked position of upper body 3. Here, rear skirt 57 is fully extended and covers the cut-outs 552 and 553 in the rear cover. When tilting upper body 3 from the parked position to the operating position, cover 55 and skirt 57 move toward rear wheels 26 and 27. In the process, skirt 57 abuts against stops 601 on lower rear housing part 6 before it touches rear wheels 26 and 27, and is thus moved to a retracted position in cover 55. When tilting upper body 3 back to the parked position, third catch elements 571 on the skirt engage fourth catch elements 602 provided on lower rear housing part 6. Skirt 57 is thus moved out of cover 55 to the extended position (FIG. 12*a*).

The present invention has been described herein based on one or more exemplary embodiments, but is not limited thereto. Reference should be had to the appended claims.

What is claimed is:

1. An upright vacuum cleaner for cleaning a surface, the upright vacuum cleaner comprising:

an upper body including a dust collection container disposed therein;

a base unit;

a carriage configured to provide movement of the base unit on the surface;

a tilting joint connecting the upper body and base unit, the tilting joint being configured to provide relative tilting between the upper body and the base unit about a tilting axis extending horizontally when the upright vacuum cleaner is in a position of use;

at least one cover configured to cover a clearance in a vicinity of the tilting joint between the upper body and the base unit; and a sliding skirt associated with the at least one cover and configured to cover a gap formed between the cover and the base unit by the tilting.

2. The upright vacuum cleaner as recited in claim 1 further comprising a movement mechanism configured to automatically move the skirt to an extended position when the tilting is a gap-increasing movement.

3. The upright vacuum cleaner as recited in claim 2 further comprising a stop mechanism operable to slide the skirt to a retracted position when the tilting is a gap-reducing movement.

4. The upright vacuum cleaner as recited in claim 1 wherein the at least one cover includes a first cover and a second cover.

5. The upright vacuum cleaner as recited in claim 4 wherein the first cover is a front cover covering a clearance at an upper region of the base unit.

6. An upright vacuum cleaner for cleaning a surface, the upright vacuum cleaner comprising:

an upper body including a dust collection container disposed therein;

a base unit;

a carriage configured to provide movement of the base unit on the surface;

a tilting joint connecting the upper body and base unit, the tilting joint being configured to provide relative tilting between the upper body and the base unit about a tilting axis extending horizontally when the upright vacuum cleaner is in a position of use;

at least one cover configured to cover a clearance in a vicinity of the tilting joint between the upper body and the base unit, the at least one cover including a first cover and a second cover, the first cover being a front cover covering a clearance at an upper region of the base unit; and a front skirt associated with the front cover and slidably supported in a guide of the base unit.

7. The upright vacuum cleaner as recited in claim 6 wherein the front skirt includes a first catch element and the front cover includes a second catch element configured to cooperate with the first catch element, the first and second catch elements being configured to move the front skirt to an extended position upon the tilting.

8. The upright vacuum cleaner as recited in claim 6 wherein the tilting joint includes a push part configured to push the front skirt to a retracted position upon the tilting.

9. The upright vacuum cleaner as recited in claim 4 wherein the second cover is a rear cover configured to cover a clearance in a lower region of the base unit.

10. The upright vacuum cleaner as recited in claim 9 wherein the rear cover includes at least one cut-out configured to prevent contact of the rear cover with at least one wheel of the base unit when the tilting results in a decrease in a gap a lower region of the base unit.

11. The upright vacuum cleaner as recited in claim 10 wherein the sliding skirt includes a rear skirt configured to cover the cut-out when the tilting results in an increase in the gap.

12. An upright vacuum cleaner for cleaning a surface, the upright vacuum cleaner comprising:

an upper body including a dust collection container disposed therein;

a base unit;

a carriage configured to provide movement of the base unit on the surface;

a tilting joint connecting the upper body and base unit, the tilting joint being configured to provide relative tilting between the upper body and the base unit about a tilting axis extending horizontally when the upright vacuum cleaner is in a position of use;

at least one cover configured to cover a clearance in a vicinity of the tilting joint between the upper body and the base unit, the at least one cover including a first cover and a second cover, the second cover being a rear cover configured to cover a clearance in a lower region of the base unit, the rear cover including at least one cut-out configured to prevent contact of the rear cover with at least one wheel of the base unit when the tilting results in a decrease in a gap a lower region of the base unit; and a rear skirt configured to cover the cut-out when the tilting results in an increase in the gap, the rear skirt being slidably attached to the rear cover.

13. The upright vacuum cleaner as recited in claim 12 wherein the rear skirt and a lower housing part of the base unit include respective cooperating catch elements configured to automatically move the rear skirt to an extended position.

14. The upright vacuum cleaner as recited in claim 12 further comprising a stop device disposed on a lower housing part of the base unit and configured to push the rear skirt to a retracted position.

15. The upright vacuum cleaner as recited in claim 14 wherein the stop device is configured to prevent contact of the rear skirt with the at least one wheel.

16. An upright vacuum cleaner for cleaning a surface, the upright vacuum cleaner comprising:

an upper body including a dust collection container disposed therein;

a base unit;

a carriage configured to provide movement of the base unit on the surface;

a tilting joint connecting the upper body and base unit, the tilting joint being configured to provide relative tilting between the upper body and the base unit about a tilting axis extending horizontally when the upright vacuum cleaner is in a position of use; and at least one cover configured to cover a clearance in a vicinity of the tilting joint between the upper body and the base unit;

wherein the tilting joint includes a yoke-shaped duct member and wherein the at least one cover is disposed on the yoke-shaped duct member.

17. The upright vacuum cleaner as recited in claim 16 wherein yoke-shaped duct member provides a swivel joint configured to allow a direction of travel of the base unit to be changed by a rotation of the upper body, and wherein the at least one cover is disposed on the yoke-shaped duct member such that a position of the cover with respect to the base unit is independent of the rotation of the upper body.

* * * * *